US006092703A

United States Patent [19]

Johnson

[11] Patent Number: 6,092,703

[45] Date of Patent: Jul. 25, 2000

[54] HOLSTER HAVING A FRONTAL REINFORCEMENT

[76] Inventor: Andrew L. Johnson, 15311 NE. 44th St., Vancouver, Wash. 98682

[21] Appl. No.: 09/186,166

[22] Filed: Nov. 5, 1998

[51] Int. Cl.[7] ..... F41C 33/02

[52] U.S. Cl. ..... 224/198; 244/192; 244/243; 244/246; 244/587; 244/911

[58] Field of Search ..... 224/587, 198, 224/911, 912, 242, 243, 246, 192, 676

[56] References Cited

U.S. PATENT DOCUMENTS

| | | | |
|---|---|---|---|
| D. 324,773 | 3/1992 | Baruch . | |
| 1,827,182 | 10/1931 | Arias . | |
| 4,303,185 | 12/1981 | Shoemaker . | |
| 4,325,506 | 4/1982 | Lindell et al. . | |
| 4,463,884 | 8/1984 | Parlante . | |
| 4,645,103 | 2/1987 | Bianchi et al. . | |
| 4,718,585 | 1/1988 | Atkins, Sr. | 224/238 |
| 4,785,983 | 11/1988 | DeSantis | 224/604 |
| 5,054,671 | 10/1991 | Else | 224/192 |
| 5,199,620 | 4/1993 | Beletsky . | |
| 5,201,447 | 4/1993 | Bumb et al. . | |
| 5,209,383 | 5/1993 | Theodore . | |
| 5,251,798 | 10/1993 | Theodore . | |
| 5,501,380 | 3/1996 | Wu . | |
| 5,570,830 | 11/1996 | Nichols . | |
| 5,820,003 | 10/1998 | Nichols | 224/575 |

FOREIGN PATENT DOCUMENTS 0312521 4/1989 European Pat. Off. .

OTHER PUBLICATIONS

Bianchi International catalog, 1996, pp. 3–4.

Milt Sparks Holsters Inc. catalog, 1996.

Galco International catalog, 1997, pp. 21, 25, 26, 27, 28.

Mitch Rosen catalog, 1997.

Michaels of Oregon Co. catalog, 1997, pp. 13, 14.

A. F. Stoeger Catalogue, Genuinee H. H. Heiser Holsters, p. 90, 1931.

*Primary Examiner*—Gregory M. Vidovich
*Assistant Examiner*—Maerema N. Brevard
*Attorney, Agent, or Firm*—Richard C. Litman

[57] ABSTRACT

A holster having a reinforced front portion to prevent the holster from collapsing under pressure from the wearer's belt when the gun is drawn. The holster is preferably made from rigid leather, molded to conform to the specific gun intended to be carried. A rigid leather reinforcement, which may also include a metal or plastic plate, along only the front portion of the holster is sufficient to keep the holster open when the gun is drawn, without increasing the thickness of the holster, thereby maintaining concealability. This reinforcement is particularly desirable for inside waistband holsters. Such an inside waistband holster may have a single central or rearward belt loop, or a pair of belt loops, with one mounted in front and the other at the rear. The belt loops may be reversible for weak side wear. Additionally, the reinforcement may be used with strong side or crossdraw belt holsters.

15 Claims, 13 Drawing Sheets

HOLSTER HAVING A FRONTAL REINFORCEMENT

BACKGROUND OF THE INVENTION

1. Field of the Invention

The present invention relates to holsters and, more specifically, to a holster having a reinforced frontal lip, providing the necessary rigidity for one-hand reholstering while preserving the thinness and concealability of the holster.

2. Description of the Related Art

Holsters intended for discreetly carrying a defensive handgun have been in existence since guns were first made small enough for concealed carry. Today, such holsters are used both by plainclothes or off duty police officers and by an increasing number of private citizens who have felt a need to take precautions to ensure their safety.

Most people who carry a handgun prefer to carry it at belt level, positioned on or slightly behind the strong side hip. A few prefer to carry the gun on or slightly in front of the weak side hip, commonly known as crossdraw carry.

One of the most popular styles of concealment holsters is the inside waistband holster. Such holsters are worn inside the waistband of the wearer's pants, slightly behind the strong side hip, with only the upper lip of the holster and grip of the gun protruding from the pants. A belt clip or loop secures the holster to the wearer's belt. The top of the holster is covered by a jacket, sweater, or untucked shirt. This type of holster is especially popular with police, because the draw from this type of holster is very similar to the draw from a duty holster, providing for simplified training and practice.

To be truly useful, such a holster must be able to perform several functions well. First, it must be easily concealed to avoid unnecessarily alarming casual observers, which is accomplished in part by keeping the thickness of the holster's leather to a minimum. Second, it must be comfortable to wear for long periods of time. Third, it must hold the gun securely in place. Fourth, it must provide quick access to the gun so that the wearer can respond properly to unexpected emergencies. Fifth, it should ideally allow for reholstering the gun using only one hand. This last function is particularly important for police, who must frequently control a suspect with one hand while reholstering a gun with the other.

Current inside waistband holsters come in two basic types. The first type is constructed of flexible, unmolded leather or nylon. This construction has several disadvantages. These holsters are not sufficiently snug fitting to hold a gun in place, and usually require the use of a safety strap passing over the gun's hammer. Even with safety straps equipped with thumb breaks, access to the gun is slowed. When the gun is drawn, belt pressure on the holster immediately causes it to collapse, requiring the wearer to use two hands in reholstering the gun.

The second type of inside waistband holster is made from rigid leather, molded in the shape of the specific gun to be used with the holster. This type of holster usually has an additional molded leather reinforcement around the front and sides of the gun pocket, and frequently includes a metal reinforcement between the holster body and leather reinforcement. The molded leather fits the gun very closely, providing a high degree of friction between the holster and gun. This friction is sufficient to hold a gun in place without the need for a safety strap, providing the fastest possible access to the gun. These holsters will remain open when the gun is drawn, allowing a the wearer to reholster the gun with one hand, without looking at the holster. However, the total thickness which must be concealed includes the gun, two layers of holster body (one on each side of the gun), two additional layers of leather reinforcement, and possible two layers of metal. All of this added thickness can create a noticeable bulge in the wearer's clothing, revealing the presence of the gun. Additionally, the holster takes up more room inside the wearer's waistband, decreasing comfort, and requiring the purchase of larger size pants.

The same considerations are also important for strong side and crossdraw holsters worn outside the belt. They must hold the gun discreetly, securely, and comfortably, and they must provide immediate access to the gun when needed. They should allow for reholstering with one hand, in case only one hand is available for the task. Ideally, they should be reinforced at the lip sufficiently so that the holster retains it's shape regardless of whether or not it contains the gun, but the holster should not add significantly to the total thickness which must be concealed.

Some holster makers have proposed the use of plastic instead of leather for holster construction, thereby providing rigidity without the necessity of using thick reinforcements. Such plastics, however, lack the aesthetic qualities of a molded leather holster.

The best examples of current holsters and reinforcement methods are shown in the catalogs of several holster manufacturers. For example, a catalog for Bianchi International from 1996 shows an inside waistband holster having a swivel mounted belt loop, and two unreinforced inside waistband holsters.

Second, a catalog for Milt Sparks Holsters, Inc. from 1996 shows several inside waistband holsters having metal reinforced front and sides, and interchangeable belt loops. One of these holsters has leather panels in front of and behind the gun pocket to enhance comfort, and another includes a waterproof membrane between layers of leather.

Third, a catalog from Galco from 1997 shows an inside waistband holster positioned behind the small of the back for a cavalry-style twist draw, two inside waistband holsters having frontal and side reinforcement and interchangeable belt loops, one of which has a rear mounted belt loop, an inside waistband magazine pouch, a pair of unreinforced holsters, an inside waistband holster intended to fit totally below the waistband, and a holster having the belt clip attached to a leather flange protruding from the bottom of the holster, allowing the wearer to tuck in his shirt around the holster.

Fourth, a catalog for Mitch Rosen from 1997 shows a variety of inside waistband holsters, all of which have front and side reinforcement. Most of them have rear mounted belt loops. One has a rear mounted belt loop in conjunction with a centrally mounted belt loop. Another has a leather panel extending below the barrel. One has its belt loop attached to a leather flange so that the wearer can tuck in his shirt around the holster.

A catalog from Michaels of Oregon from 1997 shows an unreinforced nylon inside waistband holster, and a nylon police duty holster having a thermoplastic exoskeleton along the front, sides, and rear for reinforcement.

Additionally, several patents show various proposed holster designs. For example, U.S. Pat. No. Des. 324,773, issued to Alan Baruch on Mar. 24, 1992, shows a design for a strong side belt holster having a thumb break safety strap with an additional safety strap securing the thumb break.

U.S. Pat. No. 1,827,182, issued to Manuel M. Arias on Oct. 13, 1931, describes a revolver holster having a pair of loops on either side of the inside of the holster top. When the revolver is withdrawn, the cylinder catches on the loops, requiring a slight effort to withdraw the revolver. The loops thereby prevent loss of the revolver without the need for a safety strap.

U.S. Pat. No. 4,303,185, issued to Loren R. Shoemaker on Dec. 1, 1981, describes a strong side belt holster having a vertical opening down the front of the holster, a pivot between the grip and trigger guard, and a thumb break safety strap. Drawing the pistol is accomplished by rotating the muzzle through the front opening and grip downward, bringing the pistol horizontal.

U.S. Pat. No. 4,325,506, issued to James W. Lindell and Arthur F. Barnett on Apr. 20, 1982, describes a reinforcement for a holster. The reinforcement is a pliable material along the top of the outer and rear portions of the holster, and a rivet passing through both the pliable material on either side of the rear of the holster.

U.S. Pat. No. 4,463,884, issued to Henry J. Parlante on Aug. 7, 1984, describes a security holster for a revolver. The holster has a W-shaped spring in front, pulling the two sides of the holster together, and the rear portion of the top, covering the trigger guard, is closed. This pushes the revolver rearward so that the revolver's trigger guard is underneath the closed portion of the holster top, preventing a person from removing the revolver by pulling it rearward.

U.S. Pat. No. 4,645,103, issued to John E. Bianchi, Wayne B. Gregory, and Richard D. E. Nichols on Feb. 24, 1987, describes a holster having a body constructed from closed cell foam surrounded by nylon, a stiffening member forming a front sight channel, and a safety strap secured to the back of the holster by hook and loop fasteners, allowing the length and position of the safety strap to be adjusted to accommodate different handguns. This design, while good for its intended purpose as a belt holster, will not function as an inside waistband holster. A front stiffening member, by itself, will be insufficient to keep such a holster open when the gun is drawn, because the closed cell foam and nylon construction has insufficient rigidity to be held open merely by frontal reinforcement.

U.S. Pat. No. 5,199,620, issued to Robert J. Beletsky on Apr. 6, 1993, describes a security holster. The holster has a safety strap with a thumb break. The thumb break rotates from a vertical position wherein it is used in the conventional manner to release the safety strap, and a horizontal position wherein it locks the safety strap in place.

U.S. Pat. No. 5,201,447, issued to George Bumb and Gerald L. Campagna on Apr. 13, 1993, describes a holster having a paddle attached to the inside surface for holding the holster on the waistband of a wearer's pants, and a safety strap having two portions attaching to the holster using hook and loop fasteners.

U.S. Pat. No. 5,209,383, issued to Paris Theodore on May 11, 1993, describes an upside-down shoulder holster, a belt holster, and a pocket holster, all having holster bodies constructed from one piece of material.

U.S. Pat. No. 5,251,798, issued to Paris Theodore on Oct. 12, 1993, describes an upside-down shoulder holster, a belt holster, and a pocket holster, all having holster bodies constructed from one piece of material.

U.S. Pat. No. 5,501,380, issued to Kuang-Li Wu on Mar. 26, 1996, describes a holster having a safety strap or flap secured around the handgun therein by a combination lock.

U.S. Pat. No. 5,570,830, issued to Richard E. D. Nichols on Nov. 5, 1996, describes a holster having a rigid spine with vertical grooves on either side, and side panels fastened within those grooves.

European Pat. App. No. 0,312,521, published on Apr. 19, 1989, appears to describe a strong side belt holster.

Despite the wide variety of inside waistband holsters developed by other inventors, the vast majority are either totally unreinforced, allowing them to collapse when the gun is drawn so that two hands are required for reholstering, or have reinforcing which adversely affects the bulkiness and concealability of the holster.

None of the above inventions and patents, taken either singularly or in combination, is seen to describe the instant invention as claimed. Thus a holster solving the aforementioned problems is desired.

SUMMARY OF THE INVENTION

The present invention is a molded leather holster having a reinforcement located at the front of the pocket's lip, with unreinforced sides. Such a reinforcement is particularly desirable with inside waistband holsters, and is also very useful for strong side belt holsters, crossdraw holsters, and other styles of holster. This frontal reinforcement is sufficient to keep the holster's pocket open under pressure, while placing all reinforcing material where it will not adversely affect the holster's concealability.

The frontal reinforcement may be constructed in different ways. One preferred method is to construct a holster having a leather tongue extending from the front of the holster's top. Folding this tongue over the front of the holster, and gluing and stitching it in place, creates a particularly rigid reinforcement. Collapsing the pocket of such a holster would require folding the leather reinforcement perpendicular to the original fold, which is extremely difficult to accomplish.

A second reinforcement is constructed by attaching a metal or plastic plate to the front of the holster. Either metal or plastic may be attached to the holster by stitching the plate between the holster's front and a leather reinforcement. Alternatively, a plastic plate may be stitched directly to the holster.

One preferred style of an inside waistband holster using the current reinforcement attaches to the wearer's belt by means of a rear-mounted belt loop, attached to a flange extending beyond the rear of the holster. Mounting the belt loop to the rear of the holster pocket, instead of directly on it, decreases the overall thickness which must be concealed. Additionally, the belt loop may be positioned to hold the gun at any desired angle from vertical for maximum concealment or comfort, or exchanged for a belt loop of a different size to correspond to the size of the belt.

The reinforcement may also be used with inside waistband holsters having centrally mounted belt loops. Such belt loops typically attach to the holster in the same manner as a rear mounted belt loop, with the only difference being the position of the belt loop. The centrally mounted loop has the advantage of more securely fixing the angle of the holster, and is more effective at holding the holster in position during a draw. The holster may include a rear flange to increase the bearing surface against the wearer, decreasing pressure points, or may omit this flap, decreasing the size of the holster which must fit within a wearer's waistband.

Additionally, a second belt loop may be attached to a front flange, attaching to the front reinforcement. The front belt loop, like the rear belt loop, can be reversed for right or left side wear, or exchanged for a belt loop of a different size to correspond to the wearer's belt. The front flange may be permanently attached to the holster, or may be removably attached by means of a snap fastener on the reinforcement.

The reinforcement may also be used for belt holsters, and works particularly well with a holster fastening to a belt using a loop and tunnel system. The weight of the gun and holster is supported by a tunnel mounted centrally on the holster body, and a belt loop cut through a rear flange serves to pull the gun's handgrip close to the body, maximizing concealment. With no belt loops attaching to the front of the holster, this holster design provides sufficient surface area for attaching the reinforcement. This holster design works well for both strong side and crossdraw holsters, the only difference between the two being the positioning of the belt loops so that the gun's muzzle points either straight down or slightly rearward for strong side hip holsters, or angled in the opposite direction for a crossdraw holster.

Accordingly, it is a principal object of the invention to provide a holster which will not collapse when the gun is drawn, allowing for one-hand reholstering.

It is another object of the invention to provide a holster having thin sides, so that it adds very little to the total thickness which must be concealed by the wearer.

It is a further object of the invention to provide a holster which may be quickly configured for a right handed or left handed individual.

Still another object of the invention is to provide a holster which allows the wearer to adjust the angle from vertical at which the gun is carried.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a holster having a reinforced front and unreinforced sides. Such reinforcement is particularly suited to inside waistband holsters, but is also very helpful with strong side belt and crossdraw holsters.

Figure 1:
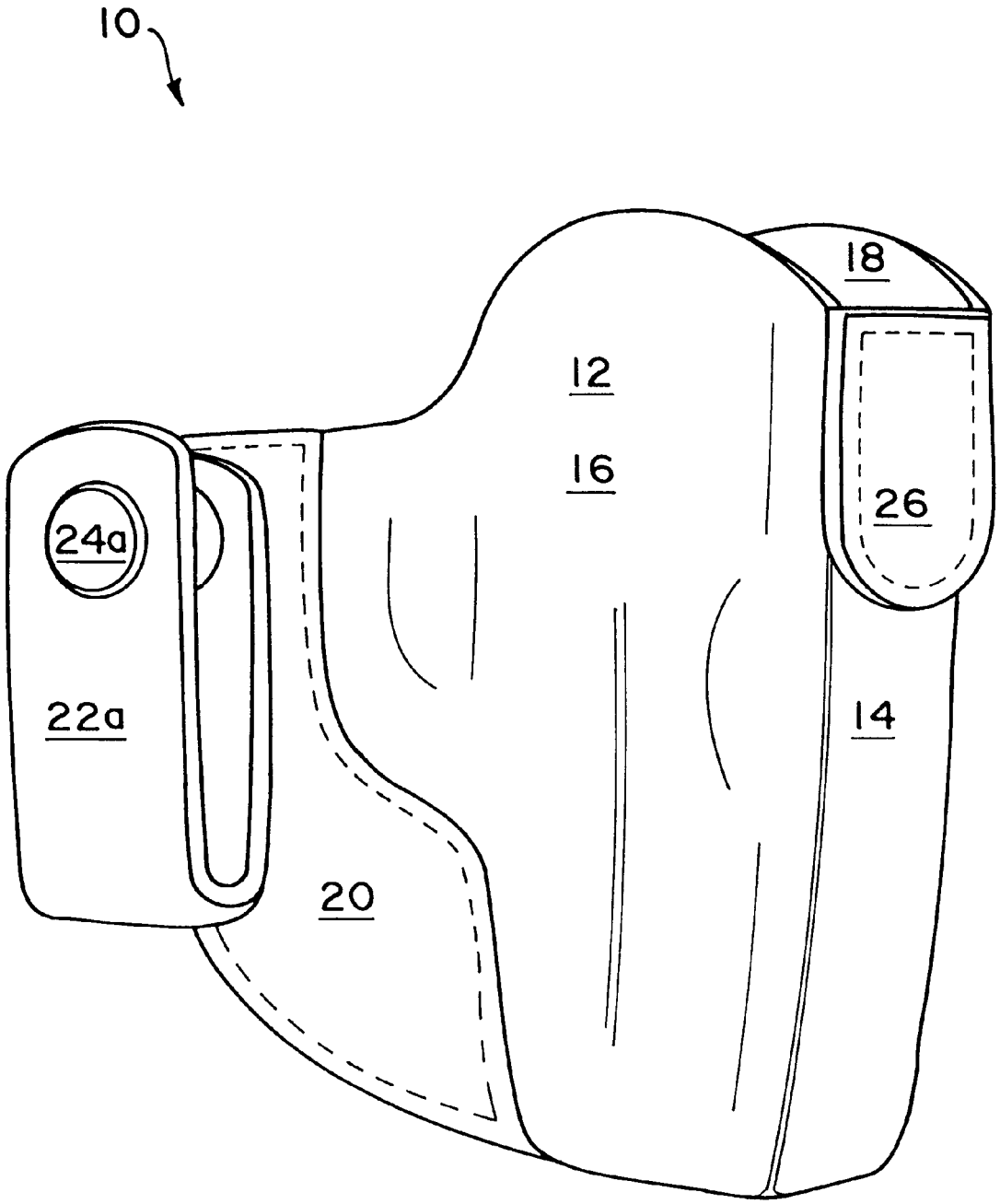
FIG. 1 is a perspective view of a first embodiment of an inside waistband holster according to the present invention, having a rear belt loop.

Referring to FIG. 1, a preferred style of inside waistband holster is illustrated. The holster 10 comprises gun pocket 12, having front 14, and sides 16,18. Ideally, holster pocket 12 will be made from rigid leather, molded to the size and shape of the gun to be carried. At the rear of gun pocket 12, sides 16 and 18 are joined together, and continue rearward to form rear flange 20. Rear belt loop 22*a* is secured in a closed position by snap 24*a*. Front reinforcement 26 is attached to the front 14 of pocket 12, but not to sides 16,18.

Figure 2:
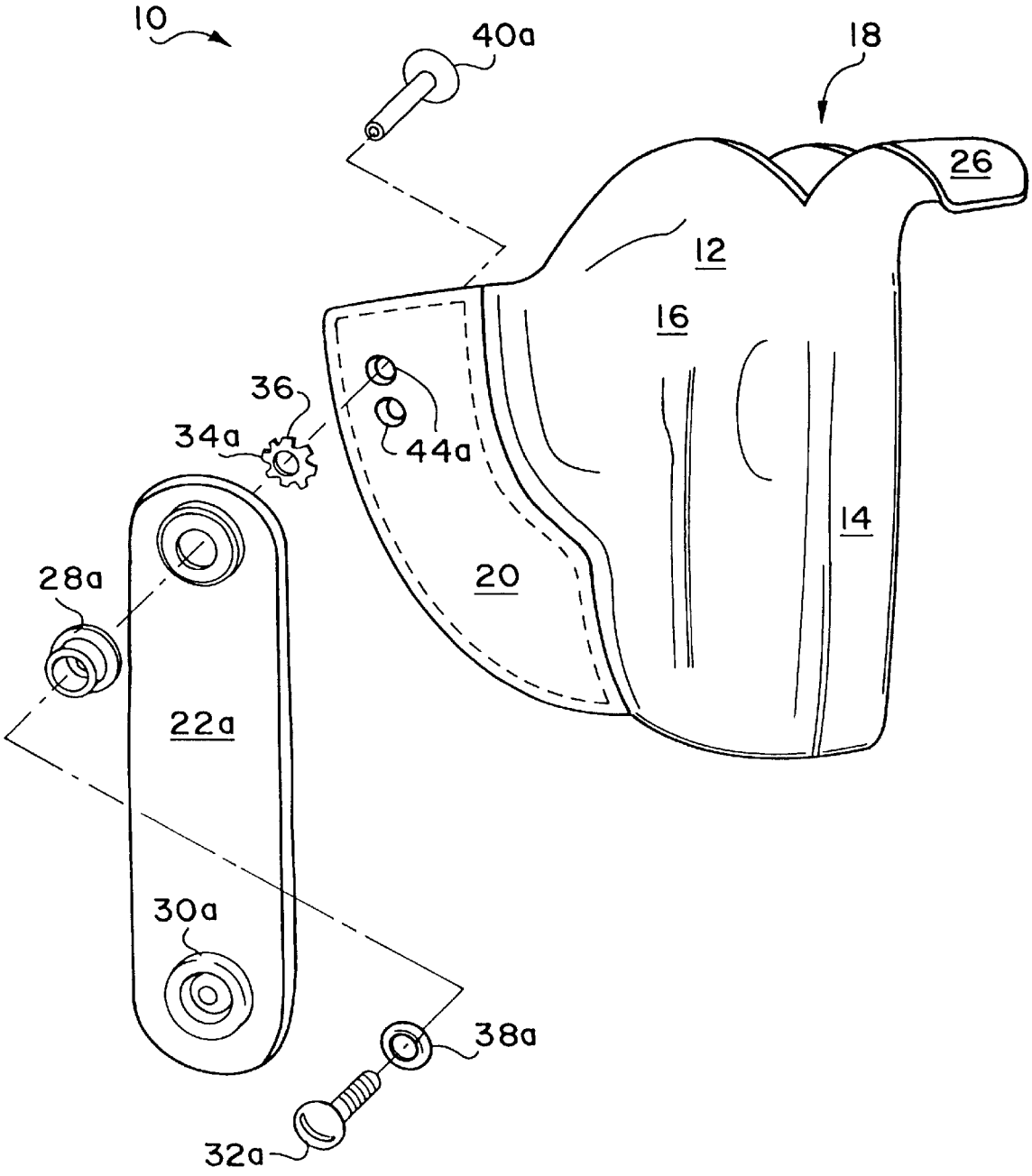
FIG. 2 is an exploded view of a first embodiment of an inside waistband holster according to the present invention.

Referring to FIG. 2, the individual components of holster 10 are illustrated. Reinforcement 26 is a tongue extending from the front 14 of holster 10, made from the same piece of leather. Reinforcement 26 is folded towards front 14, and glued and stitched into place. The snap 24*a* includes male snap component 28*a*, located at one end of belt loop 22*a*, and female snap component 30*a*, located at the opposite end of belt loop 22*a*. Belt loop 22*a* is attached to rear flange 20 by screw 32*a*, passing through male snap component 28*a*, through one of the two holes 44*a*, and into the internally threaded shaft 40*a*. Washer 34*a*, fitting between belt loop 22*a* and rear flange 20, has diagonally-oriented edges 36 to prevent belt loop 22*a* from spinning relative to rear flange 20. Washer 38*a* fits between screw 32*a* and male snap component 28*a*.

Figure 3:
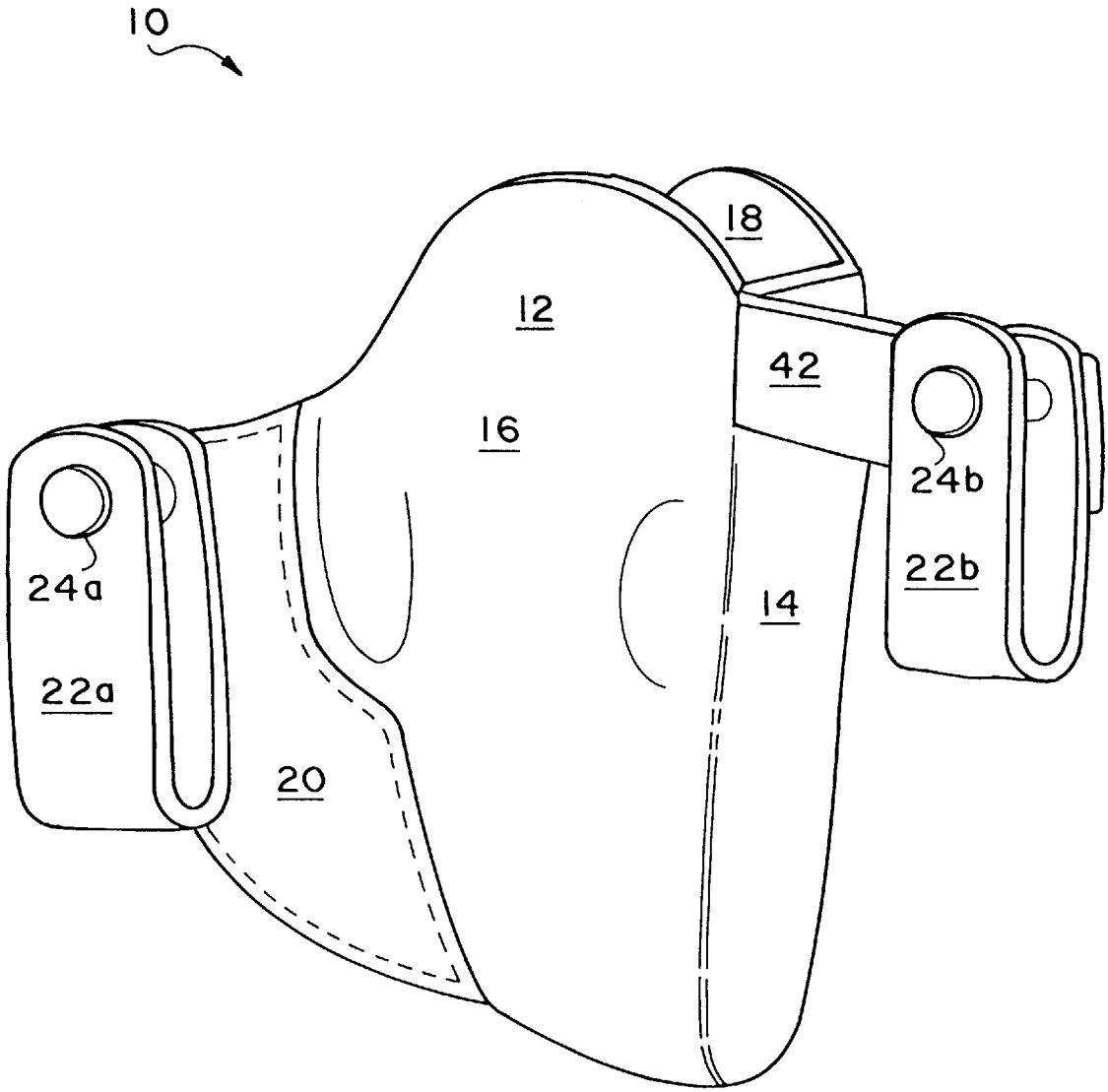
FIG. 3 is a perspective view of a second embodiment of an inside waistband holster according to the present invention, having both front and rear belt loops.
Figure 4:
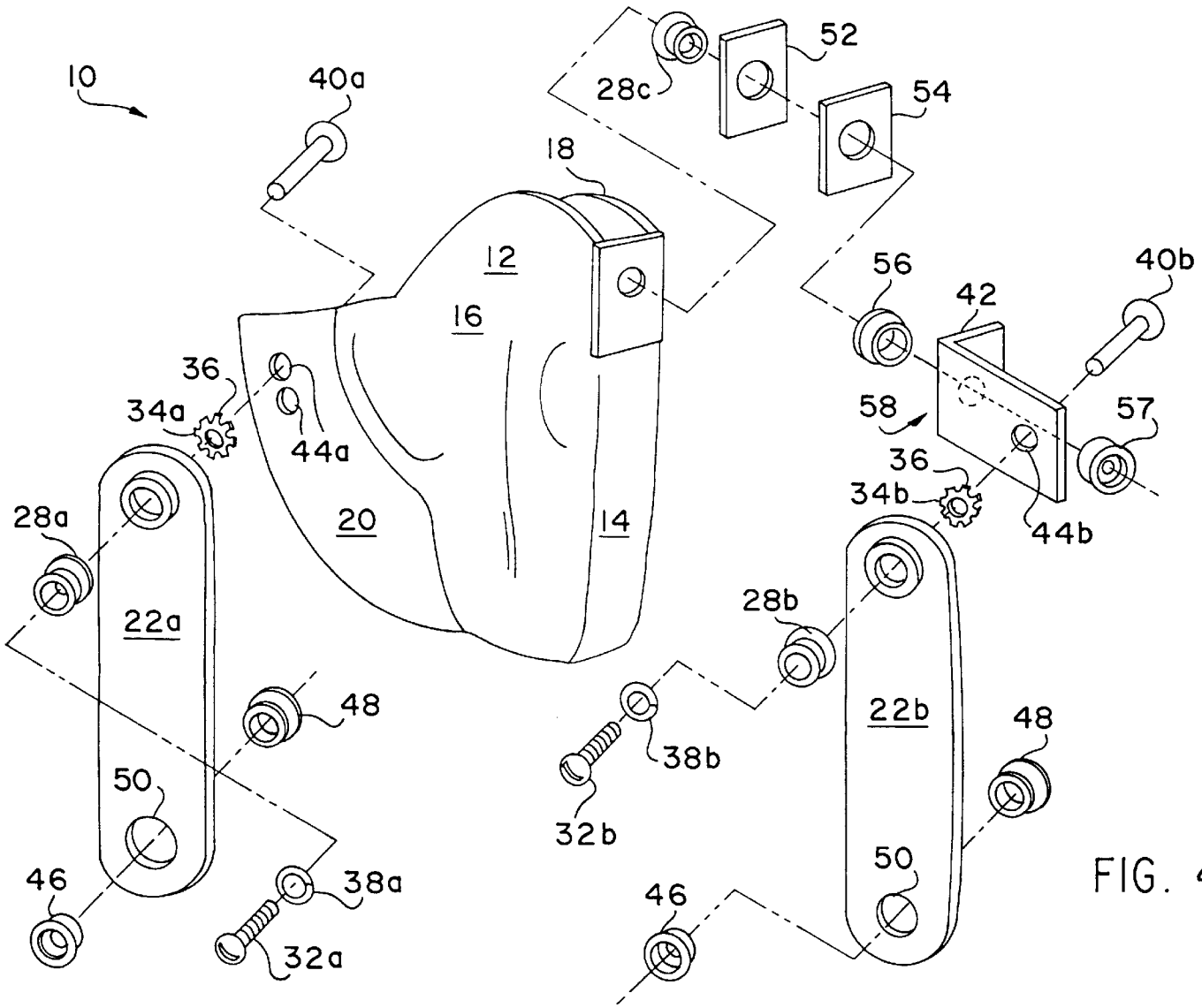
FIG. 4 is an exploded view of a second embodiment of an inside waistband holster according to the present invention.
Figure 5:
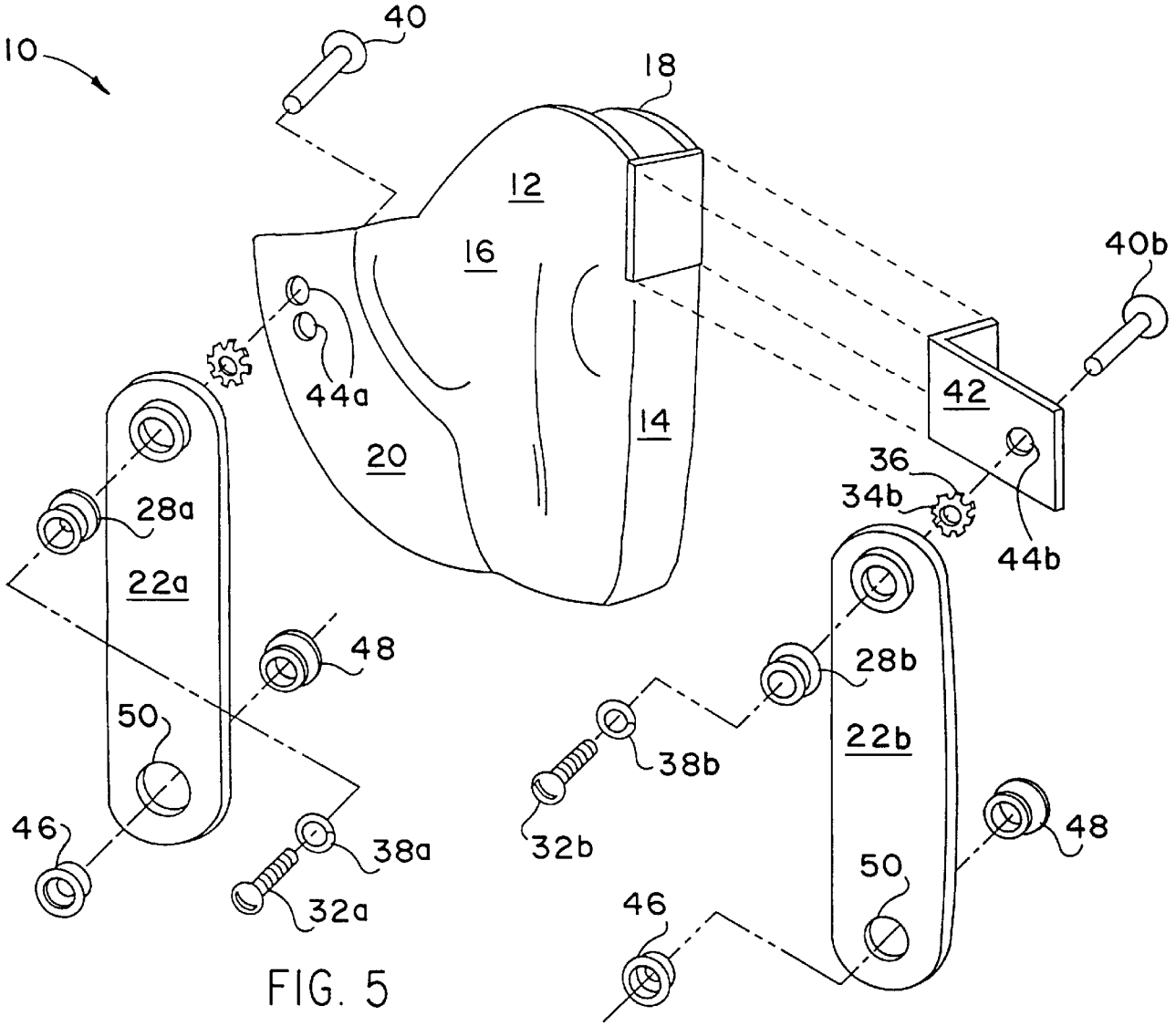
FIG. 5 is an exploded view of a second embodiment of an inside waistband holster according to the present invention, showing an alternative means of construction.

Referring to FIG. 3, holster 10 may optionally include front belt loop 22*b*, attached to front flange 42. FIGS. 4 and 5 show alternative means of attachment for front flange 42, along with alternative methods of reinforcement, with FIG. 4 showing a detachable front flange 42 and FIG. 5 showing a permanently attached front flange 42.

Referring to FIG. 4, belt loop 22*b* is attached to front flange 42 in a manner identical to the attachment of rear belt loop 22*a* to rear flange 20. Specifically, front belt loop 22*b* is attached to front flange 42 by screw 32*b*, passing through male snap component 28*b*, hole 44*b*, and into the internally threaded shaft 40*b*. Washer 34*b*, fitting between belt loop 22*b* and front flange 42, has diagonally-oriented edges 36 to prevent belt loop 22*b* from spinning relative to front flange 42. Washer 38*b* fits between screw 32*b* and male snap component 28*b*. Female snap component 46, located at one end of belt loops 22*a* and 22*b*, attaches to mating member 48 through hole 50.

The front 14 of holster 10 includes reinforcement plate 52, made from plastic or metal, under reinforcement panel 54, made from leather. Reinforcement panel 54 is stitched to holster front 14, with the stitching surrounding plate 52. Male snap component 28 is attached to reinforcement plate 52, and mates with female snap component 56, attached to flange 42. Female snap component 56 attaches to mating member 57, joining through hole 58 in flange 42. Alternatively, reinforcement plate 52 may be stitched directly to holster 10, without the use of panel 54, if reinforcement plate 52 is made from leather instead of plastic.

FIG. 5 illustrates an embodiment wherein front flange 42 is permanently stitched to the front 14 of holster 10. As in the previous embodiment, belt loop 22*b* is attached to front flange 42 in a manner identical to the attachment of rear belt loop 22*a* to rear flange 20. Specifically, front belt loop 22*b* is attached to front flange 42 by screw 32*b*, passing through male snap component 28*b*, hole 44*b*, and into the internally threaded shaft 40*b*. Washer 34*b*, fitting between belt loop 22*b* and front flange 42, has diagonally-oriented edges 36 to prevent belt loop 22*b* from spinning relative to front flange 42. Washer 38*b* fits between screw 32*b* and male snap component 28*b*.

The front 14 of holster 10 includes reinforcement plate 52, made from plastic or metal, under reinforcement panel 54, made from leather. Reinforcement panel 54 is stitched to holster front 14, with the stitching surrounding plate 52. Front flange 42 is then stitched over panel 54. Alternatively, if plate 52 is made from plastic, it may be stitched directly to the holster 10 without the use of reinforcement panel 54. Front flange 42 is then stitched over plate 52.

Figure 7:
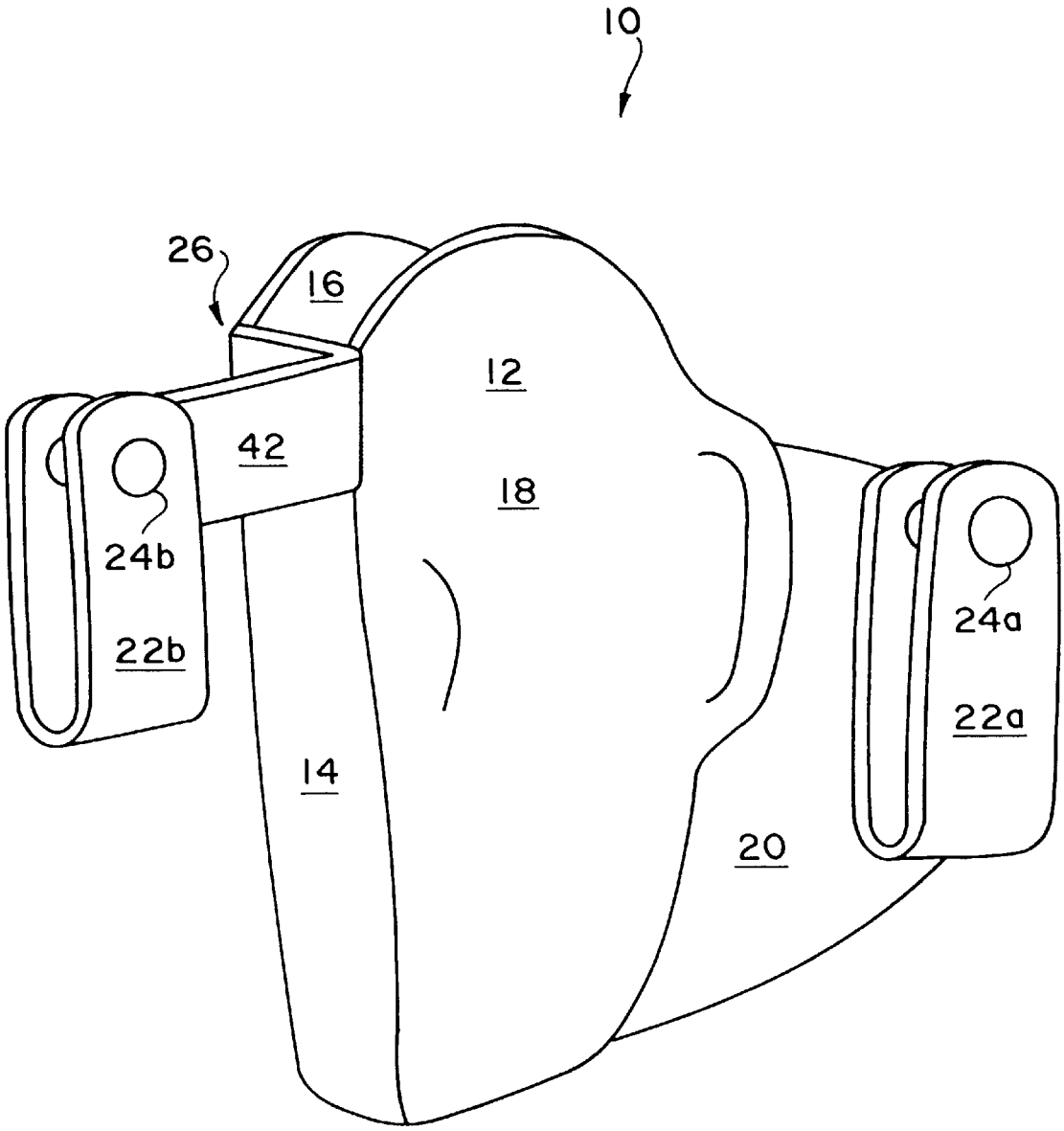
FIG. 7 is a perspective view of a second embodiment of an inside waistband holster according to the present invention, showing the holster assembled for left-hand use.

Referring to FIG. 7, any embodiments of this holster described above may be configured for right or left hand use. FIG. 7 illustrates the embodiment having a removably attached front flange, because it best illustrates the method of configuring all embodiments for weak hand use. Referring to FIGS. 4 and 7, snap 24*a* is unsnapped, and screw 32*a* is unscrewed. Belt loop 22*a*, along with washer 38*a*, male snap portion 28*a*, washer 34*a*, and threaded shaft 40*a* are removed from hole 44*a* in rear flange 20. If the width of the wearer's belt does not correspond with the opening in belt loop 22*a*, a different belt loop 22*a* may be substituted. The belt loop 22*a*, washers 38*a* and 34*a*, and male snap portion 28*a* are then moved from the side of flange 20 formed by holster side 16 to the side of flange 20 corresponding to holster side 18, while threaded shaft 40*a* is moved towards side 16. Threaded shaft 40*a* is inserted into one of the two holes 44*a*. If the wearer wants holster 10 to ride higher on the hip, the lower of the 2 holes 44*a* is used. If the wearer prefers that the holster ride lower, the higher of the two holes 44*a* is used. Washer 34*a* is placed over shaft 40*a*, followed by belt loop 22*a*, male snap portion 28*a*, washer 38*a*, and screw 32*a*. Screw 32*a* is tightened most of the way, and then the wearer rotates belt loop 22*a* around shaft 40*a* until the belt loop is properly angled relative to the vertical. The proper angle will depend entirely on the wearer's preference, and may be chosen to position the barrel vertical, to position the grips forward, or to position the muzzle forward. Screw 32*a* is tightened, causing edges 36 of washer 34*a* to bear against belt loop 22*a* and flange 20, holding the belt loop in the proper position.

Likewise, front belt loop 22*b* may be positioned for right or left hand use. Front flange 42 is attached to the front 14 of holster 10 using mating snap portions 28*c*, 56. Snap 24*b* is unsnapped, and screw 32*b* is unscrewed. Belt loop 22*b*, along with washer 38*b*, male snap portion 28*b*, washer 34*b*, and threaded shaft 40*b* are removed from hole 44*b* in front flange 42. If the width of the wearer's belt does not correspond with the opening in belt loop 22*b*, a different belt loop 22*b* may be substituted. The belt loop 22*b*, washers 38*b* and 34*b*, and male snap portion 28*b* are then moved from the side of flange 42 corresponding to holster side 16 to the side of flange 20 corresponding to holster side 18, while threaded shaft 40*b* is moved towards side 16. Threaded shaft 40*b* is inserted into hole 44*b*. Washer 34*b* is placed over shaft 40*b*, followed by belt loop 22*b*, male snap portion 28*b*, washer 38*b*, and screw 32*b*. Screw 32*b* is tightened most of the way, and then the wearer rotates belt loop 22*b* around shaft 40*b* until the belt loop is properly angled relative to the vertical. The proper angle will depend entirely on the wearer's preference, and may be chosen to position the barrel vertical, to position the grips forward, or to position the muzzle forward. Screw 32*b* is tightened, causing edges 36 of washer 34*b* to bear against belt loop 22*b* and flange 20, holding the belt loop in the proper position.

Figure 6:
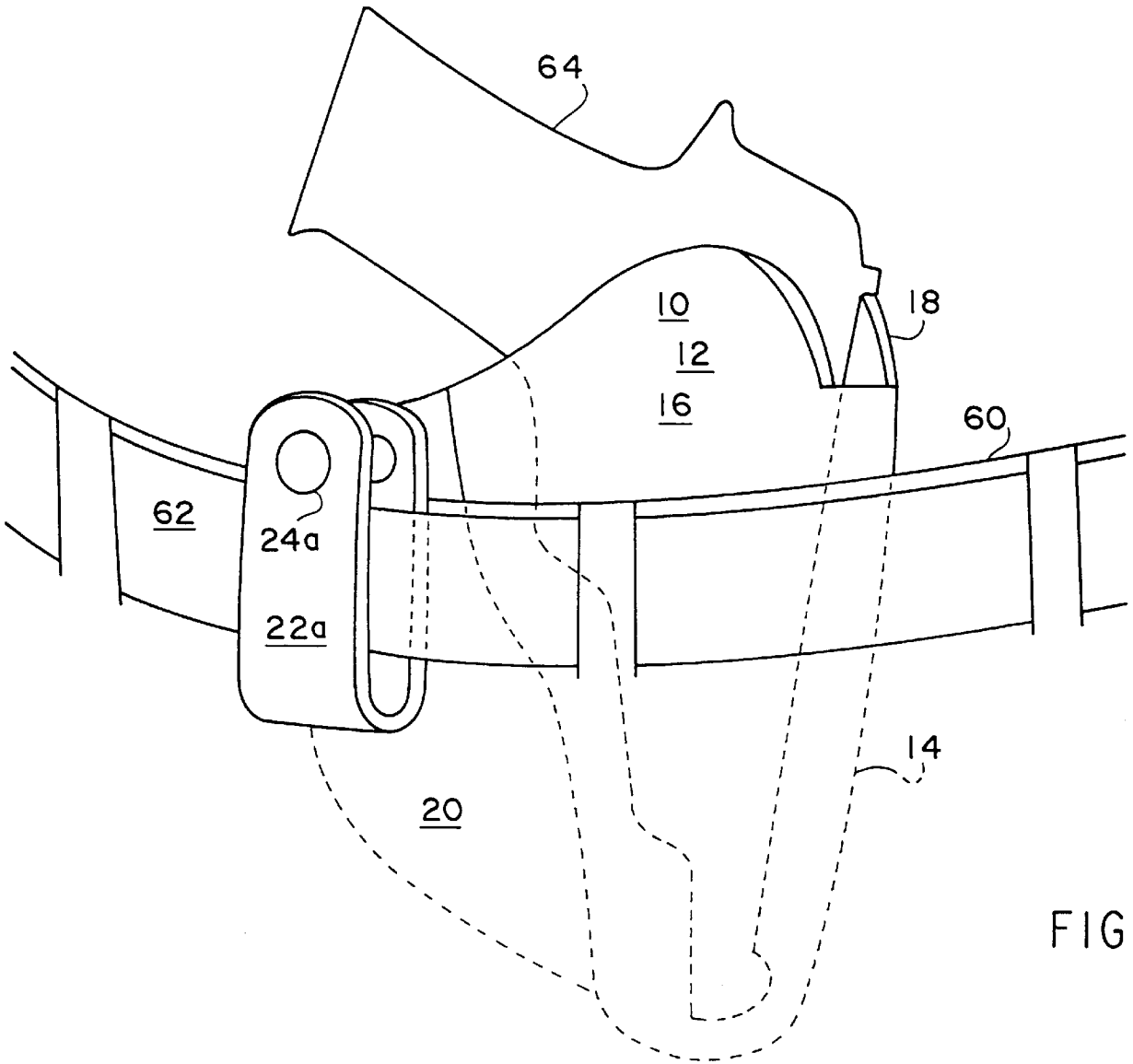
FIG. 6 is an environmental, perspective view of a first embodiment of an inside waistband holster according to the present invention.

Referring to FIG. 6, the usual method of wearing an inside waistband holster is illustrated. Holster 10 is inside pants waistband 60, with belt loop 22*a* extending over the top of waistband 60, surrounding belt 62. The holster is thereby precluded from slipping further down within waistband 60, or from rising out of waistband 60. Holster 10 is preferably made from rigid leather molded to the shape of the specific handgun 64 for which the holster 10 was designed. Such a holster construction allows the holster to fit very tightly around the handgun 64, creating a high degree of friction between holster 10 and handgun 64, preventing the handgun from leaving the holster until the wearer pulls it out.

Figure 8A:
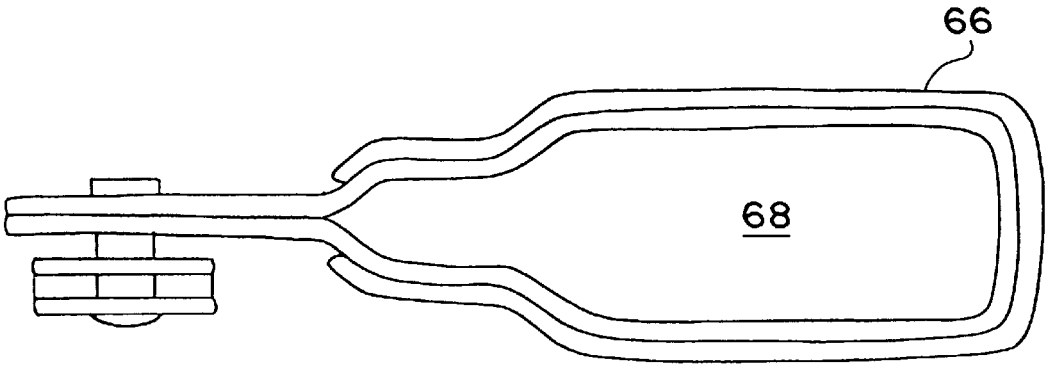
FIG. 8A (PRIOR ART)
FIG. 8A is a top perspective view of a prior art holster.
Figure 8B:
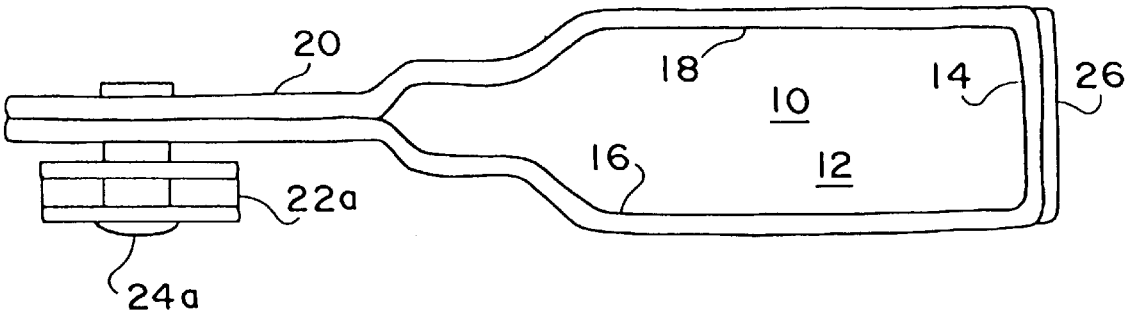
FIG. 8B is a top perspective view of a holster according to the present invention.

With the holster worn in such a manner, FIGS. 8A and 8B illustrate how the present invention has a clear advantage over a prior art holster 68. As can be seen, the prior art holster reinforcement 66, illustrated in FIG. 8A, doubles the thickness of leather surrounding the handgun 64 as compared to the reinforcement 26 of the present invention, shown in FIG. 8B. The extra thickness which must fit within a pants waistband 60 while using a prior art holster creates a larger bulge, making concealment more difficult, and also takes up more space within the waistband, decreasing comfort.

Figure 9:
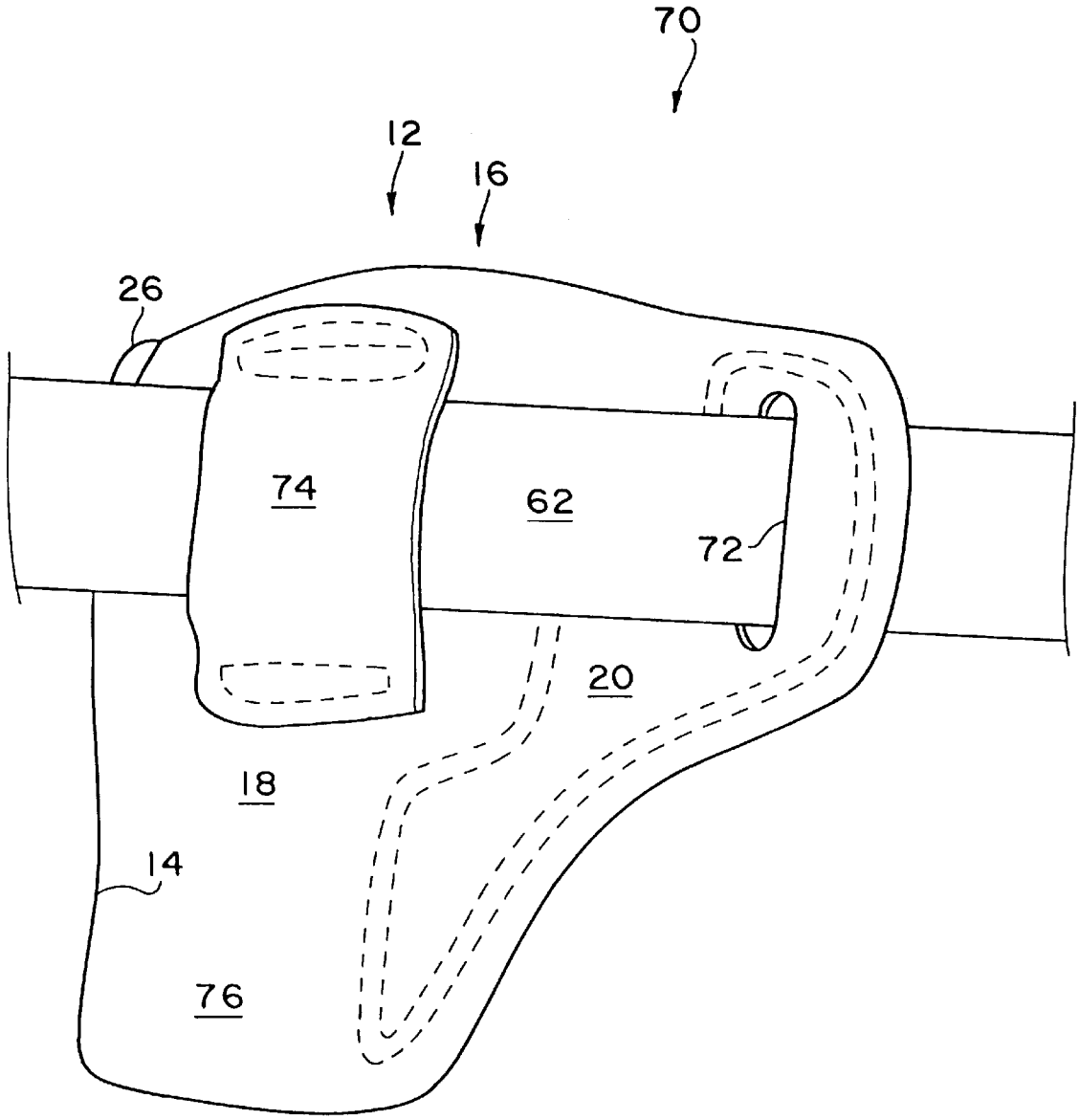
FIG. 9 is a perspective view of a strong side belt holster according to the present invention, showing the side attaching to the wearer's belt.
Figure 10:
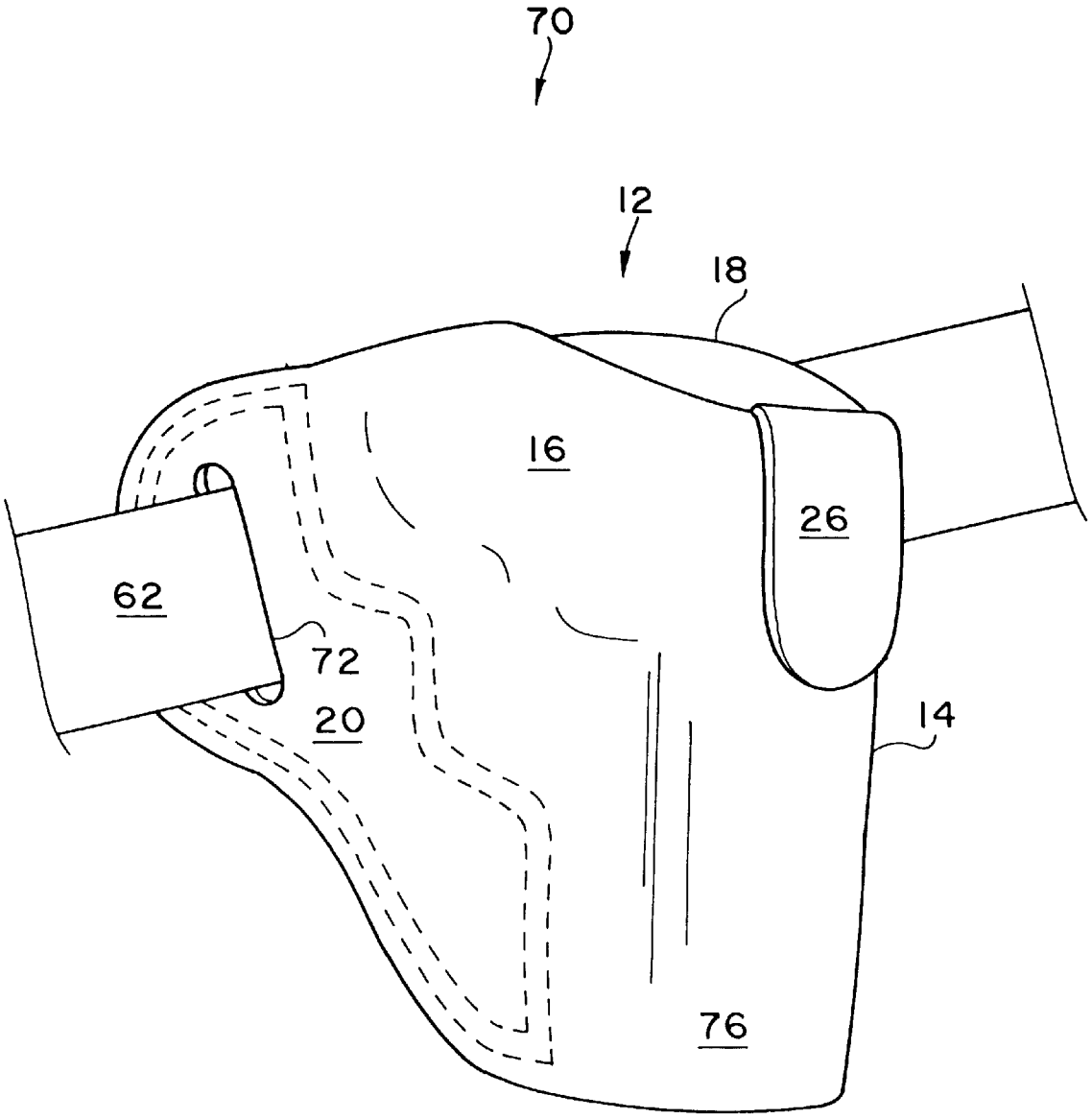
FIG. 10 is a perspective view of a strong side belt holster according to the present invention, showing the side away from the wearer's body.
Figure 11:
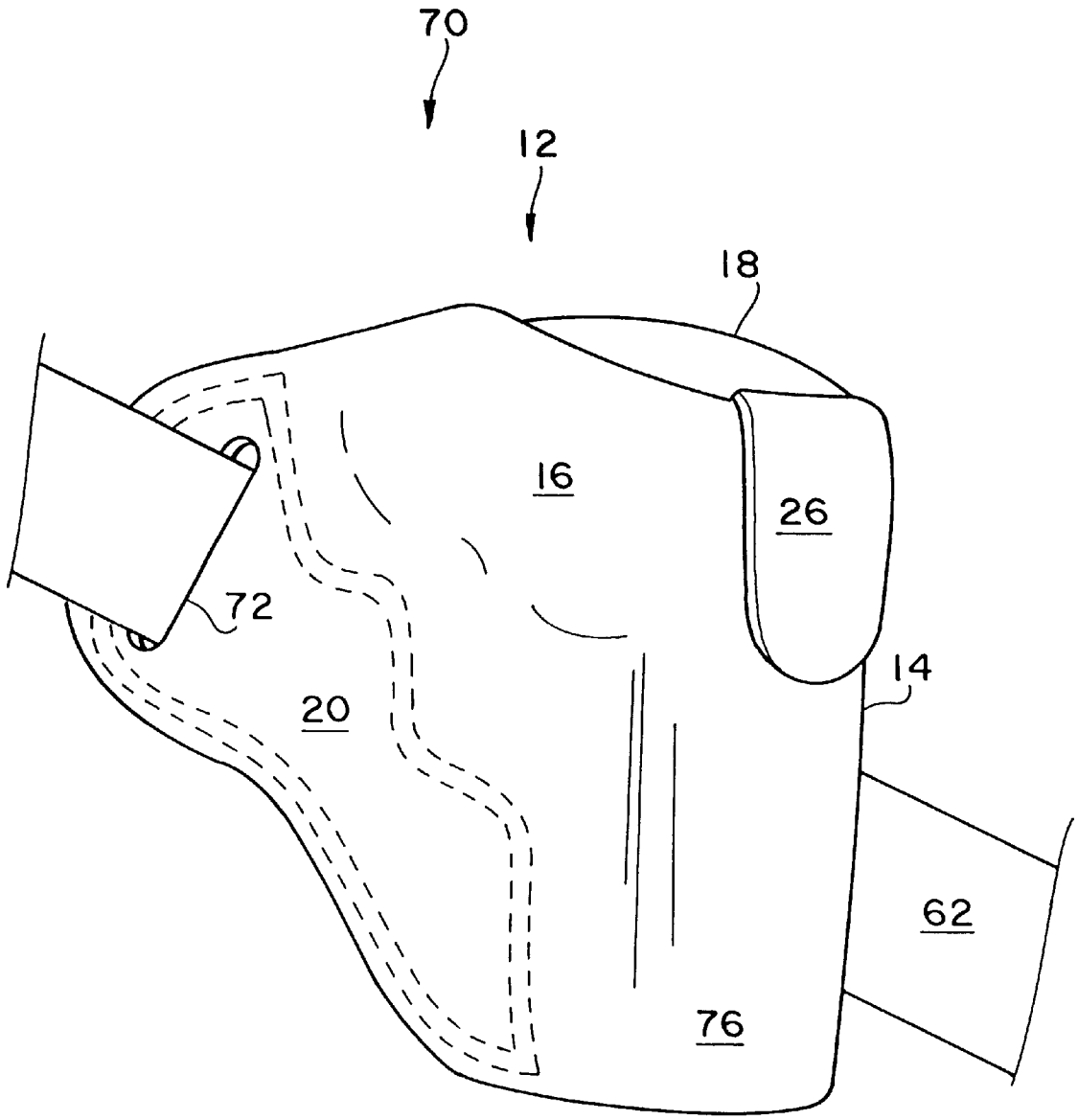
FIG. 11 is a perspective view of a crossdraw holster according to the present invention.

The reinforcement is not limited to inside waistband holsters, but is also useful for a wide variety of other styles of holster, such as strong side belt and crossdraw holsters. FIGS. 9 and 10 illustrate strong side belt holsters using the frontal reinforcement, while FIG. 11 illustrates a crossdraw holster using the reinforcement. The strong side belt holster of FIGS. 9 and 10 differs from the crossdraw holster of FIG. 11 only in the angle and positioning of the belt loop and tunnel, so these figures are best described together.

Holster 70 has a gun pocket 12, having front 14 and sides 16,18. Ideally, gun pocket 12 will be made from rigid leather, molded to fit the gun to be carried. At the rear of gun pocket 12, sides 16 and 18 are joined together, and continue rearward to form rear flange 20. Rear belt loop 72 is cut through flange 20. Tunnel 74 is secured to side 18. Referring to FIGS. 9 and 10, a vertical rear belt loop 72 and tunnel 74 is a preferred configuration for a strong side belt holster. Referring to FIG. 11, a slanted belt loop 72, and a tunnel 74 positioned closer to muzzle portion 76 of side 18 and also slanted, will position gun pocket 12 diagonally across the wearer's body. This configuration is desirable for a crossdraw holster. Referring back to FIGS. 911, it is apparent that there are no obstructions on holster front 14 to preclude placement of reinforcement 26 at this location, as might exist with a pancake style holster.

Front reinforcement 26 is attached to the front 14 of pocket 12, but not to sides 16,18. Front reinforcement 26 may be constructed exactly as shown in either FIG. 2 or FIG. 4. Referring to FIG. 2, reinforcement 26 is a tongue extending from the front 14 of holster 10, made from the same piece of leather. Reinforcement 26 is folded towards front 14, and glued and stitched into place. Alternatively, referring to FIG. 4, the front 14 of holster 10 includes reinforcement plate 52, made from plastic or metal, under reinforcement panel 54, made from leather. Reinforcement panel 54 is stitched to holster front 14, with the stitching surrounding plate 52. Reinforcement plate 52 may also be stitched directly to holster 10, without the use of panel 54, if reinforcement plate 52 is made from leather instead of plastic.

Figure 12:
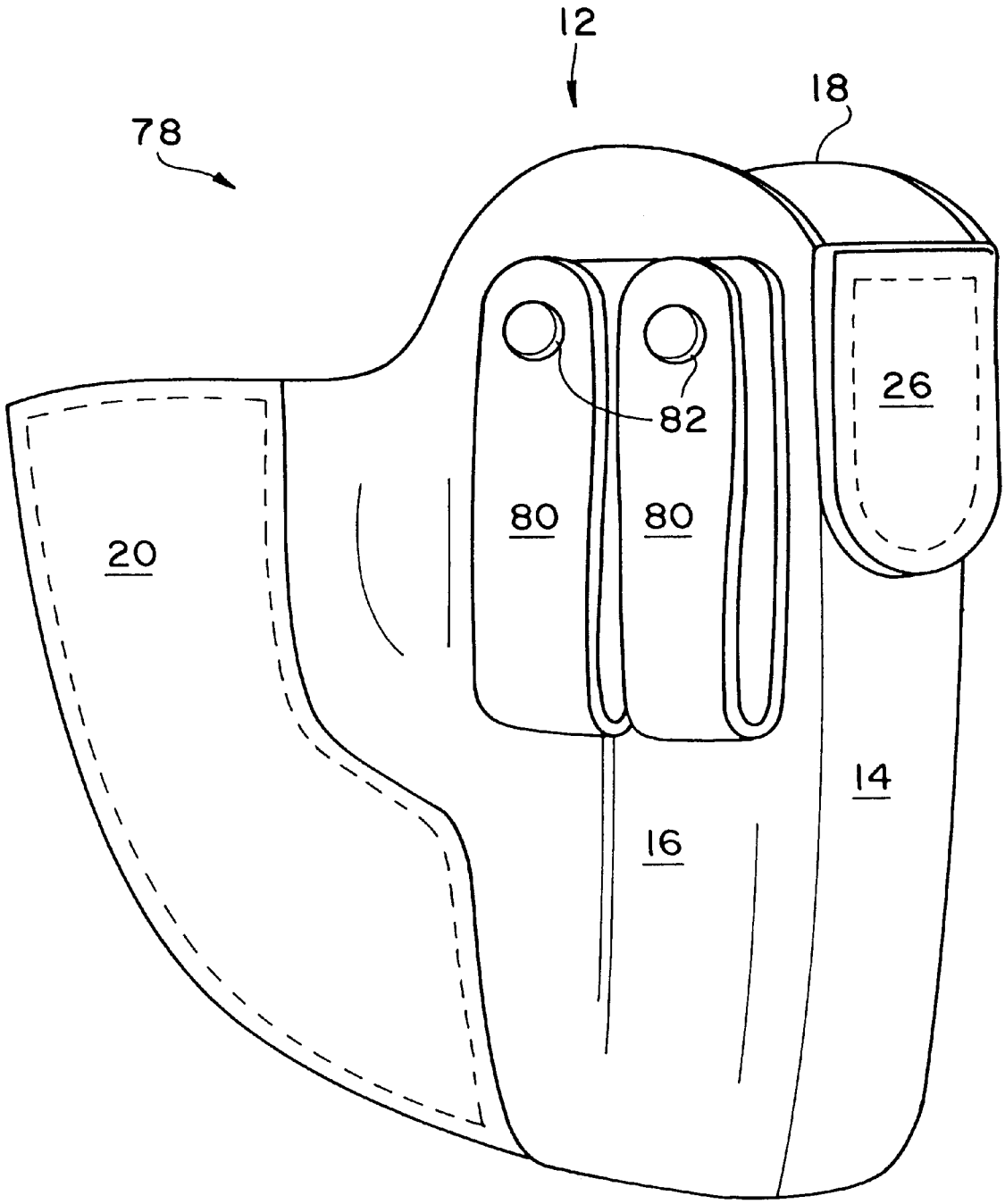
FIG. 12 is a perspective view of an inside waistband holster according to the present invention, showing a holster having centrally mounted belt loops.
Figure 13:
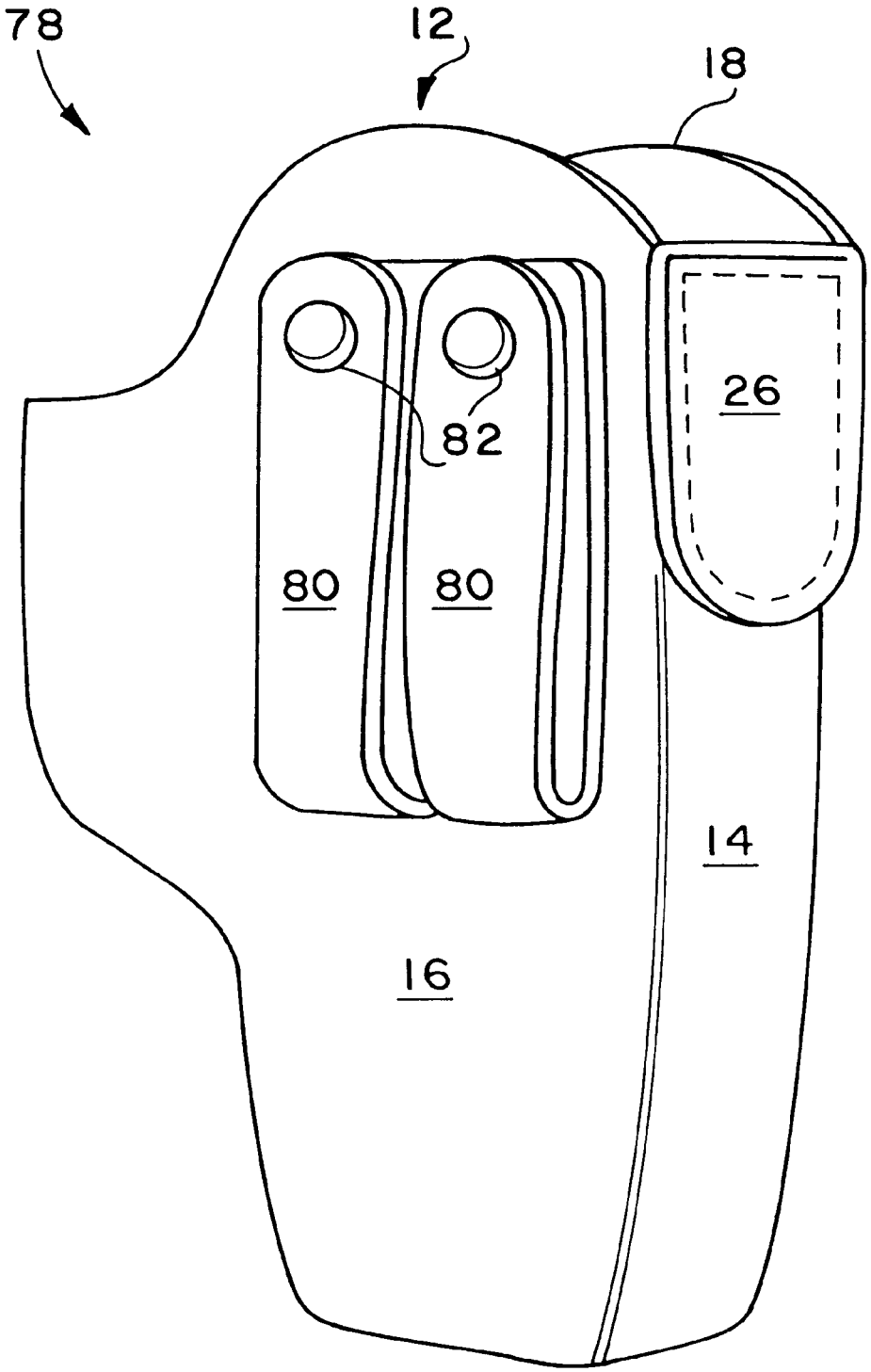
FIG. 13 is a perspective view of an inside waistband holster according to the present invention, showing a holster having centrally mounted belt loops, and omitting the rear flange.

FIGS. 12 and 13 show a different style of inside waistband holster which also benefits from the use of frontal reinforcement. Holster 78 has a gun pocket 12, having front 14 and sides 16,18. Ideally, gun pocket 12 will be made from rigid leather, molded to fit the gun to be carried. At the rear of gun pocket 12, sides 16 and 18 are joined together, and continue rearward to form rear flange 20. Rear flange 20 increases the surface area bearing against the wearer, decreasing the pressure. Alternatively, some users will prefer to omit rear flange 20 as shown in FIG. 13, reducing the size holster which must be worn within the waistband. Referring back to FIGS. 12–13, a pair of belt loops 80 are attached to side 16 at the point of snaps 82, in a conventional manner.

Front reinforcement 26 is attached to the front 14 of pocket 12, but not to sides 16,18. Front reinforcement 26 may be constructed exactly as shown in either FIG. 2 or FIG. 4. Referring to FIG. 2, reinforcement 26 is a tongue extending from the front 14 of holster 10, made from the same piece of leather. Reinforcement 26 is folded towards front 14, and glued and stitched into place. Alternatively, referring to FIG. 4, the front 14 of holster 10 includes reinforcement plate 52, made from plastic or metal, under reinforcement panel 54, made from leather. Reinforcement panel 54 is stitched to holster front 14, with the stitching surrounding plate 52. Reinforcement plate 52 may also be stitched directly to holster 10, without the use of panel 54, if reinforcement plate 52 is made from leather instead of plastic.

It is to be understood that the present invention is not limited to the embodiments described above, but encompasses any and all embodiments within the scope of the following claims.

I claim:

1. A holster for carrying a handgun, said holster comprising:

a gun pocket having a top, a lip adjacent to said top, a front, a pair of opposing sides, a back, an outside surface, and an inside surface;

a reinforcement panel made from a leather tongue extending from said holster top, said leather tongue being folded over and attached to said front of said gun pocket, said reinforcement panel being free of covering any portion of said sides;

a flexible flange attached to said panel of said gun pocket, said flange adaptable to receive a belt loop; and means for securing said holster to a belt.

2. The holster according to claim 1, wherein said holster is made from leather.

3. The holster according to claim 1, wherein said holster is molded to the shape of the handgun.

4. The holster according to claim 1, wherein said holster is configured for attaching to the outside of a wearer's belt.

5. The holster according to claim 4, further comprising:

a rear flange attached to said holster back, defining a slot within said rear flange, said slot being dimensioned and configured to receive a belt; and a tunnel attached to one of said sides, said tunnel being dimensioned and configured to receive a belt.

6. A holster for carrying a handgun, said holster being configured for carrying the handgun inside a pants waistband and comprising:

a gun pocket having a top, a lip adjacent to said top, a front, a pair of opposing sides, a back, an outside surface, and an inside surface;

a reinforcement panel attached to said front of said gun pocket, said reinforcement panel being free of covering any portion of said sides;

a first belt loop for securing said holster to a belt, said first belt loop being mounted rearward of said holster back;

a flexible flange attached to said top of said holster front, said flexible flange having a pair of sides; and a second belt loop mounted on said flexible flange.

7. The holster according to claim 6, further comprising means for removably attaching said flexible flange to said holster.

8. The holster according to claim 7, wherein said means for removably attaching said flexible flange to said holster comprise a snap fastener.

9. The holster according to claim 6, further comprising means for removably attaching said second belt loop to said flange.

10. The holster according to claim 9, further comprising means for removably, selectively attaching said second belt loop to either side of said flange.

11. The holster according to claim 9, wherein said second belt loop further comprises:

a first end and a second end;

a screw, a male portion of a snap fastener attached to said first end by means of said screw; and a female portion of a snap fastener attached to said second end.

12. The holster according to claim 6, further comprising means for removably, selectively attaching said first belt loop to either side of said flange.

13. The holster according to claim 6, wherein said first belt loop further comprises:

a first end and a second end;

a screw, a male portion of a snap fastener attached to said first end by means of said screw; and a female portion of a snap fastener attached to said second end.

14. The holster according to claim 6, wherein a rigid plate is disposed under said reinforcement panel.

15. The holster according to claim 14, wherein said rigid plate is made from a material selected from the group of metal or plastic.

* * * * *